US007441413B2

(12) United States Patent
Bae et al.

(10) Patent No.: US 7,441,413 B2
(45) Date of Patent: Oct. 28, 2008

(54) REFRIGERATOR AND CONTROL METHOD THEREOF

(75) Inventors: Hak-Gyun Bae, Andong (KR); Eung-Ryeol Seo, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 599 days.

(21) Appl. No.: 11/106,488

(22) Filed: Apr. 15, 2005

(65) Prior Publication Data

US 2005/0235667 A1 Oct. 27, 2005

Related U.S. Application Data

(63) Continuation-in-part of application No. 10/814,799, filed on Apr. 1, 2004, now abandoned.

(30) Foreign Application Priority Data

Mar. 23, 2004 (KR) ..... 2004-19700
Mar. 16, 2005 (KR) ..... 10-2005-0021920

(51) Int. Cl.
*F25B 41/00* (2006.01)
*F25B 49/00* (2006.01)

(52) U.S. Cl. ..... 62/198; 62/197

(58) Field of Classification Search ..... 62/197, 62/198, 199, 200, 157, 158, 205, 206, 527
See application file for complete search history.

(56) References Cited

U.S. PATENT DOCUMENTS 6,672,089 B2 1/2004 Park et al.
2002/0043073 A1 * 4/2002 Park et al. ..... 62/231

FOREIGN PATENT DOCUMENTS

| | | |
|---|---|---|
| KR | 1997-0004337 | 3/1997 |
| KR | 0140930 | 3/1998 |
| KR | 2004-0003876 | 1/2004 |
| KR | 2004-0000963 | 7/2004 |

OTHER PUBLICATIONS

U.S. Appl. No. 10/814,799, filed Apr. 2004, Bae et al., Samsung Electronics Co., Ltd.

* cited by examiner

*Primary Examiner*—Chen-Wen Jiang
(74) *Attorney, Agent, or Firm*—Staas & Halsey LLP

(57) ABSTRACT

A refrigerator and a control method thereof in which a smooth flow of a refrigerant can be provided through an effective control for a path change valve when a flow path of the refrigerant is changed between two evaporators having different pressures. The refrigerator includes low-pressure-side and high-pressure-side evaporators, a path change device, and a controller. The path change device changes a refrigerant flow path between the low-pressure-side evaporator and the high-pressure-side evaporator, and has a simultaneous opening stage to simultaneously establish refrigerant flow paths respectively communicating with the low-pressure-side evaporator and high-pressure-side evaporator during the path change. The controller controls the path change device such that the simultaneous opening stage established when the refrigerant flow path is changed from the low-pressure-side evaporator to the high-pressure-side evaporator is longer than the simultaneous opening stage established when the refrigerant flow path is changed from the high-pressure-side evaporator to the low-pressure-side evaporator.

8 Claims, 5 Drawing Sheets

REFRIGERATOR AND CONTROL METHOD THEREOF

CROSS-REFERENCE TO RELATED APPLICATION

This is a continuation-in-part of prior U.S. application Ser. No. 10/814,799, filed on Apr. 1, 2004, now abandoned, to which the benefit is claimed under 35 U.S.C. § 120.

This application claims the benefit of Korean Patent Application Nos. P2004-19700 and P2005-21920, filed on Mar. 23, 2004 and Mar. 16, 2005 in the Korean Intellectual Property Office, the disclosure of which is incorporated herein by reference.

BACKGROUND OF THE INVENTION

1. Field of the Invention

The present invention relates to a refrigerator, and, more particularly, to a refrigerator defined with freezing and refrigerating compartments, and equipped with independent evaporators respectively installed at the freezing and refrigerating compartments.

2. Description of the Related Art

Generally, a refrigerator includes a body defined with freezing and refrigerating compartments partitioned by an intermediate partition wall. Doors are hingably coupled to the refrigerator body in front of the freezing and refrigerating compartments to open and close the freezing and refrigerating compartments, respectively. An evaporator and a fan are arranged at an inner wall portion of the refrigerator body defining the freezing compartment, in order to generate cold air and to supply the generated cold air to the freezing compartment. Another evaporator and another fan are arranged at an inner wall portion of the refrigerator body defining the refrigerating compartment, in order to generate cold air and to supply the generated cold air to the refrigerating compartment. Thus, cold air is supplied into the freezing and refrigerating compartments in an independent fashion. Such a system is called an "independent cooling system".

The reason why the system of cooling the freezing and refrigerating compartments in an independent fashion is used is that the target cooling temperature required in the refrigerating compartment is relatively higher than that required in the freezing compartment. In order to implement different cooling temperatures in the freezing and refrigerating compartments, respectively, the evaporators of the freezing and refrigerating compartments should have different evaporation temperatures, respectively. To this end, expansion (pressure reduction) of a refrigerant at an upstream side from each evaporator should be carried out in such a manner that the expansion degrees at respective upstream sides from the evaporators are different from each other. Accordingly, separate expansion devices are installed at respective upstream ends of the evaporators.

The independent cooling system may also implement independent cooling of a selected one of the freezing and refrigerating compartments. In order to independently cool a selected one of the freezing and refrigerating compartments, it is necessary to control a flow path of the refrigerant such that the refrigerant circulates through an associated one of the evaporators for the freezing and refrigerating compartments.

Different evaporation temperatures of the evaporators for the freezing and refrigerating compartments mean different refrigerant pressures of the evaporators. Such a refrigerant pressure difference causes the refrigerant to flow through one of the evaporators in a larger quantity, so that the refrigerant may not smoothly flow through the other evaporator when the refrigerant flow path is changed.

SUMMARY OF THE INVENTION

Therefore, it is an aspect of the invention to provide a refrigerator capable of providing a smooth flow of a refrigerant through two evaporators having different pressures in accordance with an effective control for a path change valve when a flow path of the refrigerant is changed between the high-pressure-side and low-pressure-side evaporators by the path change valve.

Additional aspects and advantages of the invention will be set forth in part in the description which follows and, in part, will be obvious from the description, or may be learned by practice of the invention.

The foregoing and/or other aspects of the present invention are achieved by providing a refrigerator including a plurality of evaporators, a path change device, and a controller. The plurality of evaporators may comprise at least one low-pressure-side evaporator and at least one high-pressure-side evaporator. The path change device may change a flow path of a refrigerant between the low-pressure-side evaporator and the high-pressure-side evaporator, and may have a simultaneous opening stage to simultaneously establish refrigerant flow paths respectively communicating with the low-pressure-side evaporator and the high-pressure-side evaporator during the path change. The controller may control the path change device such that the simultaneous opening stage established when the flow path of the refrigerant is changed from the low-pressure-side evaporator to the high-pressure-side evaporator is longer than the simultaneous opening stage established when the flow path of the refrigerant is changed from the high-pressure-side evaporator to the low-pressure-side evaporator.

The low-pressure-side evaporator may be a freezing compartment evaporator to cool a freezing compartment of the refrigerator, and the high-pressure-side evaporator may be a refrigerating compartment evaporator to cool a refrigerating compartment of the refrigerator.

The simultaneous opening stage established when the flow path of the refrigerant is changed from the high-pressure-side evaporator to the low-pressure-side evaporator may be an opening stage inevitably established due to a mechanical characteristic limitation of the path change device, and the simultaneous opening stage established when the flow path of the refrigerant is changed from the low-pressure-side evaporator to the high-pressure-side evaporator may be an intentional opening stage longer than the inevitable simultaneous opening stage.

The path change device may be a 3-way valve to change the refrigerant flow path in accordance with a rotation of a stepping motor, and the mechanical characteristic limitation of the path change device may be a rotating speed limitation of the stepping motor.

According to another aspect, the present invention provides a refrigerator including a plurality of evaporators, and a path change device. The plurality of evaporators may comprise at least one low-pressure-side evaporator and at least one high-pressure-side evaporator. The path change device may change a flow path of a refrigerant between the low-pressure-side evaporator and the high-pressure-side evaporator, and may have a simultaneous opening stage to simultaneously establish refrigerant flow paths respectively communicating with the low-pressure-side evaporator and the high-pressure-side evaporator when the refrigerant flow path is changed from the low-pressure-side evaporator to the high-pressure-side evaporator.

In accordance with another aspect, the present invention provides a refrigerator including a refrigerating compartment evaporator, a freezing compartment evaporator, a first expansion device, a second expansion device, a path change device, and a controller. The first expansion device may expand a flow of a refrigerant introduced into the refrigerating compartment evaporator to a first pressure, and the second expansion device may expand a flow of the refrigerant introduced into the freezing compartment evaporator to a second pressure lower than the first pressure. The path change device may change a flow path of a refrigerant between the freezing compartment evaporator and the refrigerating compartment evaporator, and may have a simultaneous opening stage to simultaneously establish refrigerant flow paths respectively communicating with the freezing compartment evaporator and the refrigerating compartment evaporator when the flow path of the refrigerant is changed from the freezing compartment evaporator to the refrigerating compartment evaporator.

The controller may control the path change device so that the simultaneous opening stage is maintained for a predetermined time when the refrigerant flow path is changed from the freezing compartment evaporator to the refrigerating compartment evaporator.

BRIEF DESCRIPTION OF THE DRAWINGS

The above and/or other aspects of the present invention will become more apparent after reading the following detailed description when taken in conjunction with the drawings, in which.

DETAILED DESCRIPTION OF THE PREFERRED EMBODIMENTS

Figure 1:
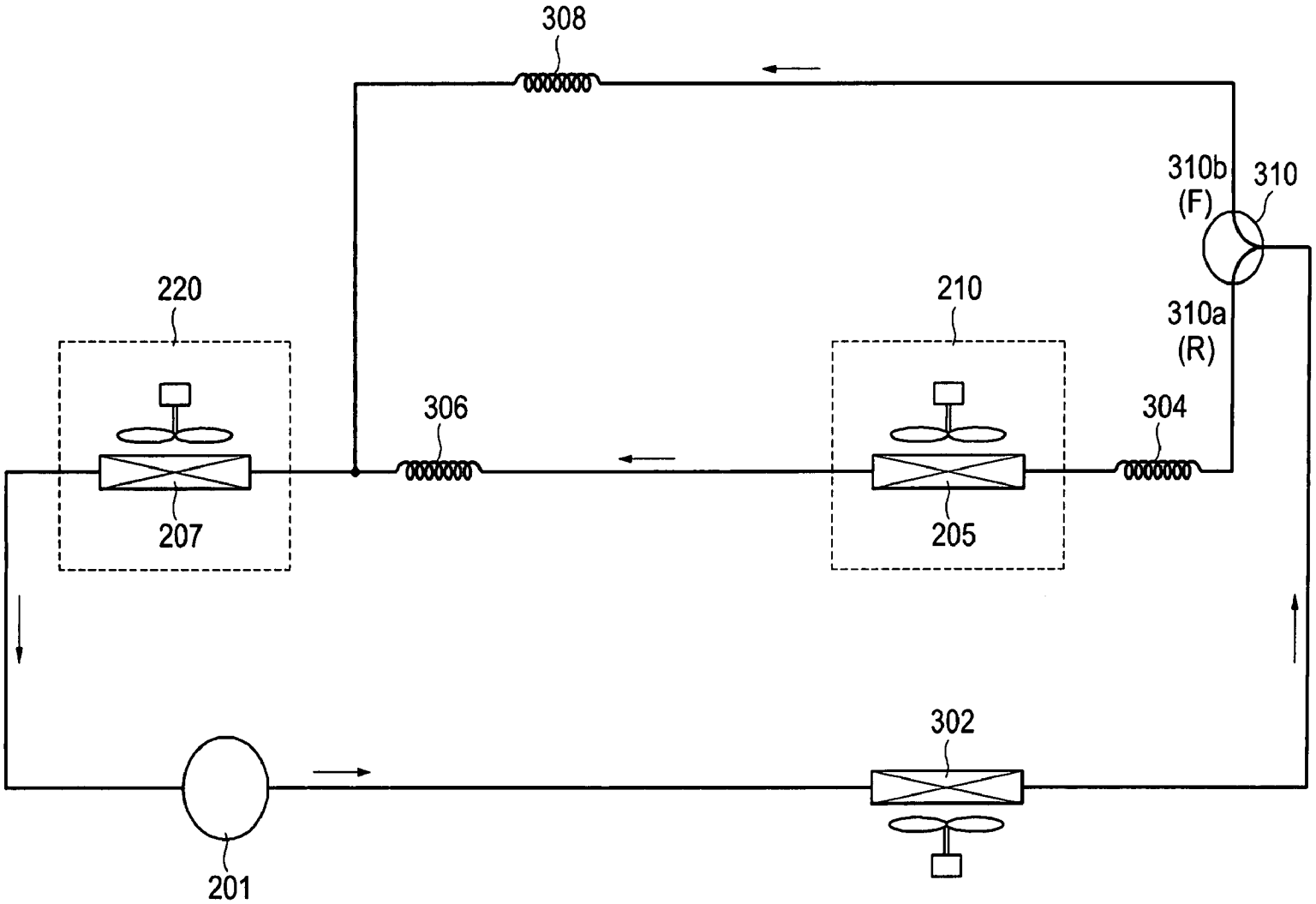
FIG. 1 is a circuit diagram illustrating a refrigerant cycle established in a refrigerator according to an exemplary embodiment of the present invention.

Preferred embodiments of the present invention will now be described in detail with reference to FIGS. 1 to 4. FIG. 1 is a circuit diagram illustrating a refrigerant cycle established in a refrigerator according to an exemplary embodiment of the present invention. Referring to FIG. 1, a refrigerant, which is discharged from a compressor 201, may be introduced into a refrigerating compartment capillary tube 304 or a freezing compartment capillary tube 308 after passing through a condenser 302 when a flow path thereof is changed in accordance with operation of a 3-way valve 310. For example, when the 3-way valve 310 is operated such that a refrigerating compartment valve 310*a* thereof is closed, whereas a freezing compartment valve 310*b* thereof is opened, the refrigerant emerging from the condenser 302 is introduced only into the freezing compartment evaporator 207 through the freezing compartment capillary tube 308. In this case, cooling is carried out in the freezing compartment 220 alone. On the other hand, in a refrigerating compartment cooling mode in which both the refrigerating compartment 210 and the freezing compartment 220 are cooled, the 3-way valve 310 is operated to open the refrigerating compartment valve 310*a* while closing the freezing compartment valve 310*b*. In this case, the refrigerant emerging from the condenser 302 is introduced into the refrigerating compartment evaporator 205 and then into the freezing compartment evaporator 207 via the refrigerating compartment capillary tube 304 and a connecting capillary tube 306.

The 3-way valve 310 is configured to change the refrigerant flow path in accordance with rotation of a stepping motor (not shown). That is, a refrigerant flow path, which communicates with at least one of the refrigerating compartment evaporator 205 and freezing compartment evaporator 207, is established in accordance with rotation of the stepping motor. The change of the refrigerant flow path caused by rotation of the stepping motor will now be described with reference to FIG. 2.

Figure 2:
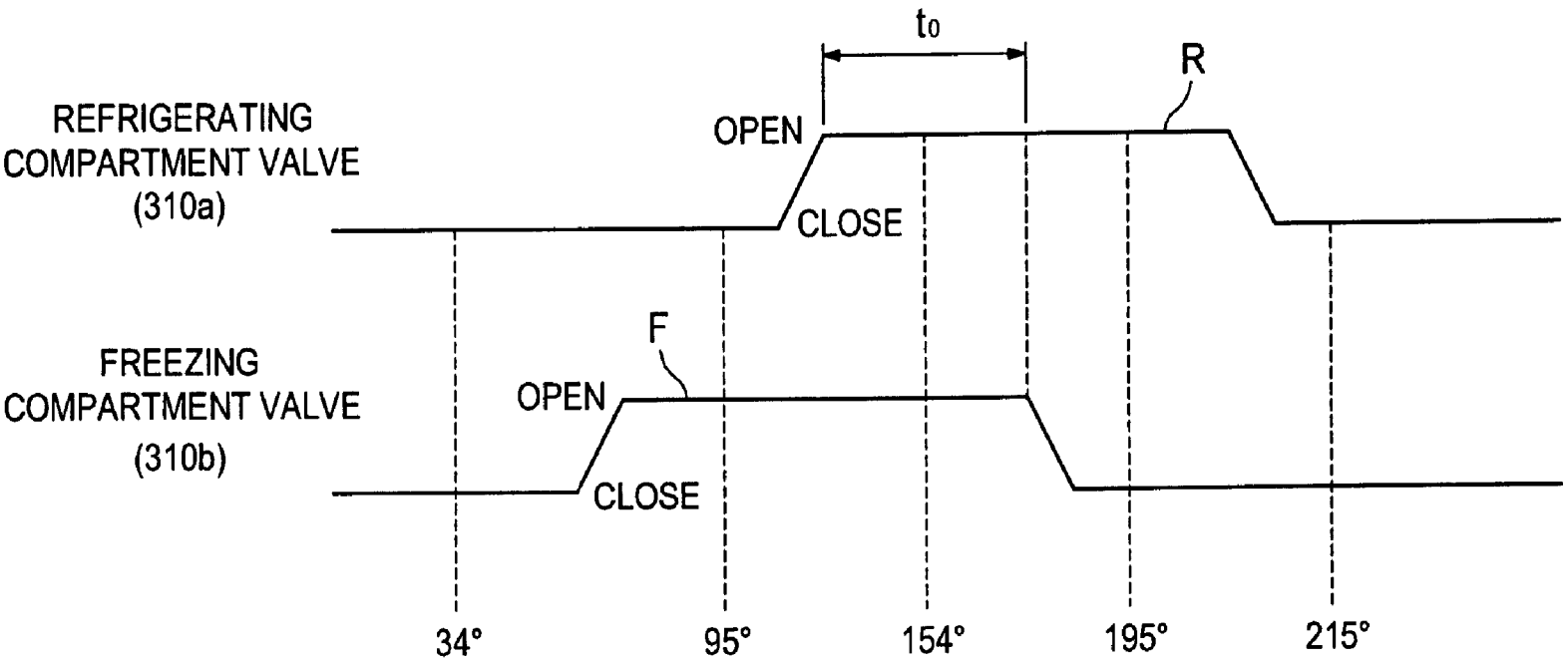
FIG. 2 is a timing chart illustrating a concept of controlling a 3-way valve in the refrigerator according to the illustrated embodiment of the present invention.

FIG. 2 is a timing chart illustrating a concept of controlling the 3-way valve in the refrigerator according to the illustrated embodiment of the present invention. As shown in FIG. 2, a refrigerant flow path is established when a selected one of the refrigerating compartment valve 310*a* and freezing compartment valve 310*b* is opened in accordance with a rotation angle of the stepping motor. When the rotation angle of the stepping motor is 34°, both the refrigerating compartment valve 310*a* and the freezing compartment valve 310*b* are closed, so that no refrigerant flow path is established which communicates with the refrigerating compartment evaporator 205 or freezing compartment evaporator 207. When the stepping motor further rotates to about 95°, the freezing compartment valve 310*b* is opened while the refrigerating compartment valve 310*b* is still in the closed state thereof. In this state, a refrigerant flow path is established which communicates with the freezing compartment evaporator 207 via the freezing compartment capillary tube 308. In accordance with a further rotation of the stepping motor to about 154°, the refrigerating compartment valve 310*b* is also opened. That is, a simultaneous opening stage, in which both the refrigerating compartment valve 310*a* and the freezing compartment valve 310*b* are opened, is established. When the stepping motor further rotates to about 195°, the freezing compartment valve 310*b* is closed while the refrigerating compartment valve 310*a* is still in the opened state thereof. In this state, a refrigerant flow path is established which communicates with only the refrigerating compartment evaporator 205 via the refrigerating compartment capillary tube 304. In accordance with a further rotation of the stepping motor to 215°, both the refrigerating compartment valve 310*a* and the freezing compartment valve 310*b* are closed. As a result, there is no refrigerant flow path communicating with the refrigerating compartment capillary tube 304 or the freezing compartment capillary tube 308.

In such a manner, establishment of a desired refrigerant flow path is determined in accordance with rotation of the stepping motor adapted to control opening/closing of the 3-way valve 310. As described above, in a certain rotation angle range of the stepping motor, for example, about 154° in the case of FIG. 2, there is a simultaneous opening stage t0 in which both the refrigerating compartment valve 310*a* and the freezing compartment valve 310*b* are opened. In this stage to, the refrigerant can flow toward both the refrigerating compartment evaporator 205 and the freezing compartment evaporator 207. In the simultaneous opening stage to, however, the refrigerant flows toward the refrigerating compartment evaporator 205 in a larger quantity because the pressure of the freezing compartment evaporator 207 is relatively lower than that of the refrigerating compartment evaporator 205. For this reason, when the operation mode of the refrigerator is changed from a mode for cooling the freezing compartment alone to a mode for cooling the refrigerating compartment alone (that is, the rotation angle of the stepping motor is changed from 95° to 195° via the range of about 154°), the refrigerant, which flows toward the freezing compartment evaporator 207, instantaneously flows back toward the refrigerating compartment evaporator 205. As a result, it is impossible to sufficiently supply the refrigerant toward the freezing compartment evaporator 207. This is because the refrigerant present in the refrigerating compartment evaporator 205 is introduced into the freezing compartment evaporator 207 in the mode for cooling the freezing compartment alone because the pressure of the freezing compartment evaporator 207 is lower than the pressure of the refrigerating compartment evaporator 205, so that the quantity of the refrigerant left in the refrigerating compartment evaporator 205 in the mode for cooling the freezing compartment alone is little. In order to solve this problem, when the operation mode of the refrigerator is changed from the mode for cooling the freezing compartment alone to the mode for cooling the refrigerating compartment alone, that is, when the rotation angle of the stepping motor is changed from 95° to 195° via the range of about 154°, the simultaneous opening stage to corresponding to the range of about 154° is maintained for a relatively lengthened period of time (about 10 seconds). In this case, the refrigerant can flow into both the refrigerating compartment evaporator 205 and the freezing compartment evaporator 207 for a sufficient period of time to allow the refrigerant to be sufficiently and smoothly supplied through the refrigerant flow path communicating with the refrigerating compartment evaporator 205 without being cut off.

Figure 3:
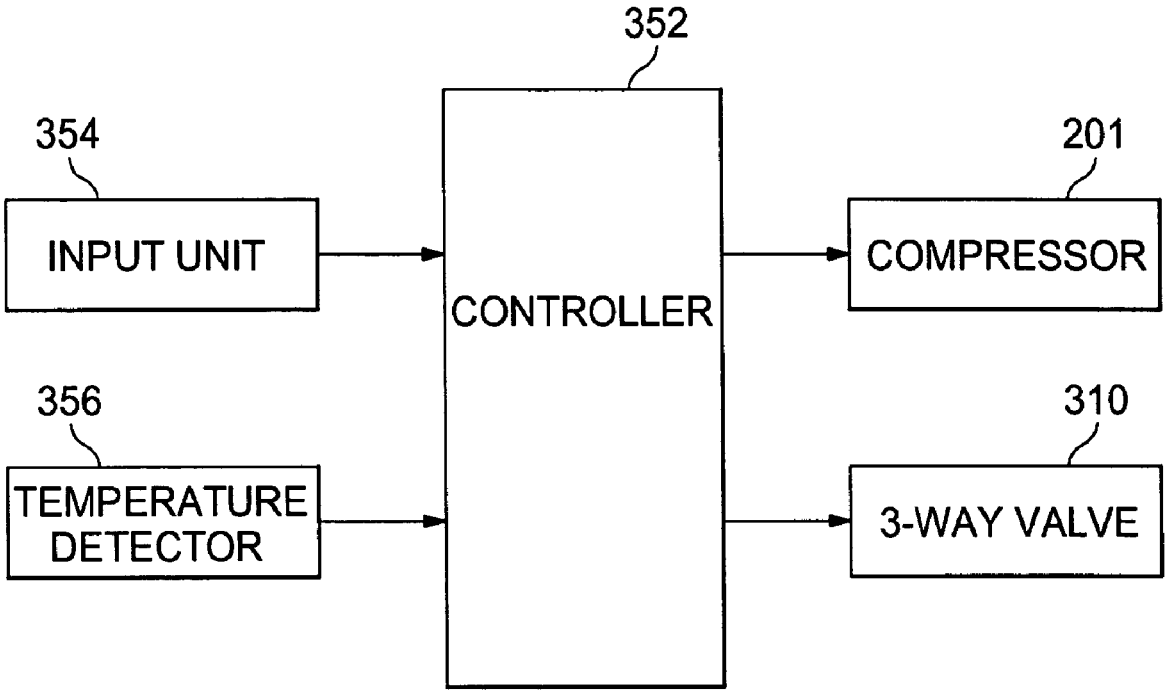
FIG. 3 is a block diagram illustrating a control system used in the refrigerator according to the illustrated embodiment of the present invention.

In order to achieve such a control operation, the refrigerator according to the illustrated embodiment of the present invention includes a control system shown in FIG. 3. FIG. 3 is a block diagram illustrating the control system used in the refrigerator according to the illustrated embodiment of the present invention. Referring to FIG. 3, an input unit 354 and a temperature detector 356 are connected to an input of a controller 352 adapted to control the overall operation of the refrigerator. The input unit 354 allows the user to set a desired target cooling temperature, a desired cooling mode, or other operating conditions. The temperature detector 356 detects respective temperatures of the refrigerating compartment 210, freezing compartment 220, refrigerating compartment evaporator 205, and freezing compartment evaporator 207, and informs the controller 352 of the detected temperatures. Based on the detected temperatures, the controller 352 controls the cooling operation of the refrigerator. The 3-way valve 310 is electrically connected to an output of the controller 352, along with a compressor 201. The 3-way valve 310 and compressor 201 are controlled by the controller 352 to implement a cooling mode set by the user and to achieve a target cooling temperature set by the user. Such a control operation of the controller 352 will now be described with reference to FIGS. 4 and 5.

Figure 4:
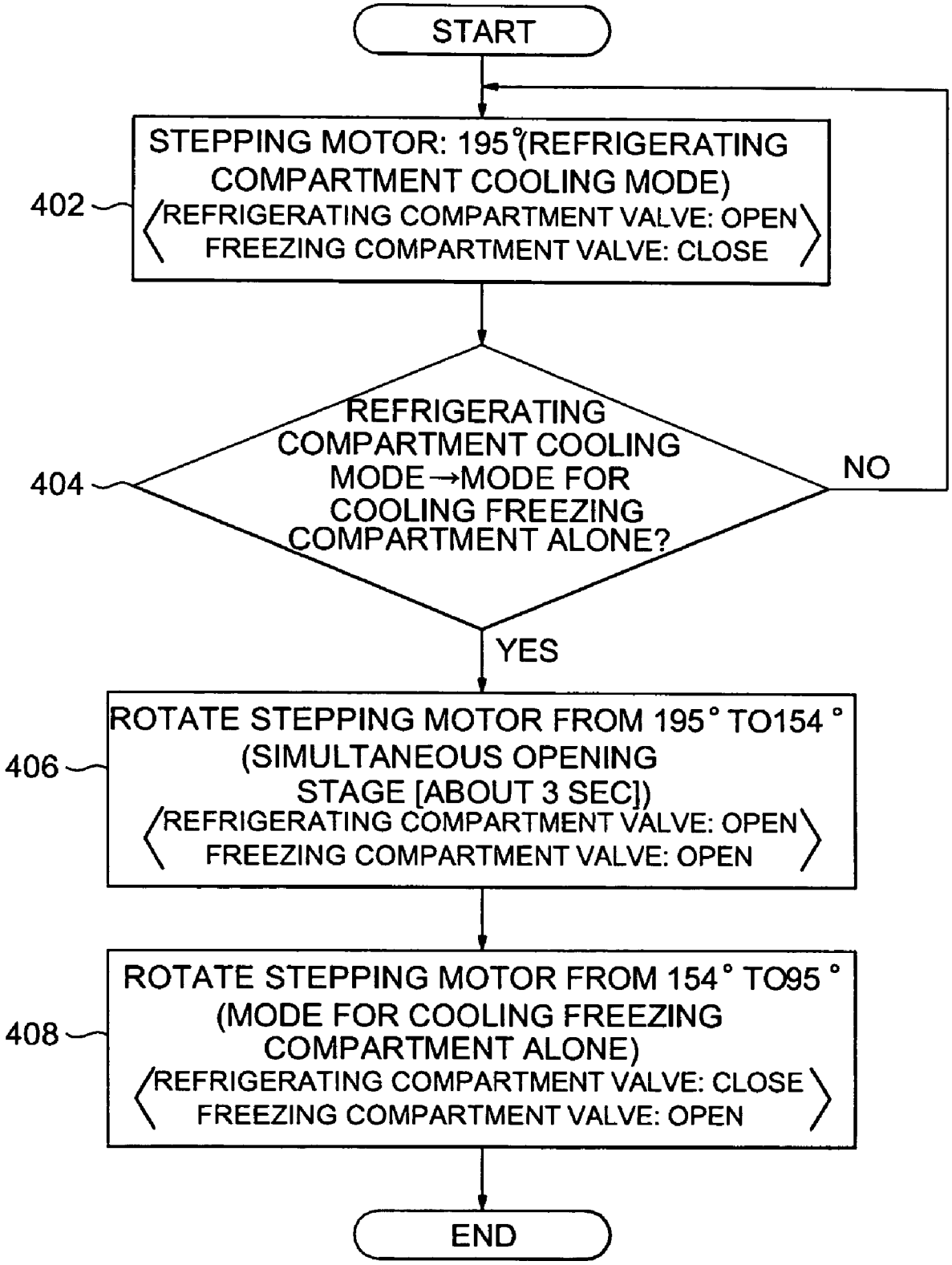
FIG. 4 is a flow chart illustrating a method for controlling the 3-way valve to change a refrigerant flow path from a refrigerating compartment evaporator to a freezing compartment evaporator.

FIG. 4 is a flow chart illustrating a method for controlling the 3-way valve to change the refrigerant flow path from the refrigerating compartment evaporator to the freezing compartment evaporator. As shown in FIG. 4, in a state of the 3-way valve 310 corresponding to a 195°-rotated state of the stepping motor, the refrigerating compartment valve 310*a* is opened, whereas the freezing compartment valve 310*b* is closed. In this state, accordingly, a refrigerating cooling mode is executed to sequentially cool both the refrigerating compartment 210 and the freezing compartment 220 (Operation 402). After completion of the cooling of the refrigerating compartment 210 to the target refrigerating compartment temperature, the controller 352 determines whether or not the temperature of the freezing compartment 220 reaches the target freezing compartment temperature, and thus, determines whether or not it is necessary to cool the freezing compartment 220 alone. Based on this determination, the controller 352 determines whether or not the refrigerant flow path is to be changed from the refrigerating compartment 210 to the freezing compartment 220 for execution of the mode for cooling the freezing compartment 220 alone (Operation 404). When it is necessary to change the refrigerant flow path from the refrigerating compartment 210 to the freezing compartment 220, the controller 352 changes the rotation angle of the stepping motor from 195° to 154° (Operation 406). This procedure is an intermediate procedure involved in a procedure in which the stepping motor is rotated to 95°. In accordance with the intermediate procedure, a simultaneous opening stage is established, in which both the refrigerating compartment valve 310*a* and the freezing compartment valve 310*b* are opened. Where the refrigerant flow path is to be changed from the refrigerating compartment 210 to the freezing compartment 220, the stepping motor is rotated to 95° without any intentional delay in the simultaneous opening stage, thereby closing the refrigerating compartment valve 310*a* while opening only the freezing compartment valve 310*b* to cool only the freezing compartment 220. That is, the mode for cooling the freezing compartment 220 alone is executed (Operation 408). The simultaneous opening stage, in which both the refrigerating compartment valve 310*a* and the freezing compartment valve 310*b* are opened, is limited to a minimal period (for example, 3 seconds) inevitably present in accordance with the rotating speed of the stepping motor. Of course, when the rotating speed of the stepping motor is very high, such a simultaneous opening stage may not exist. Thus, the time, for which both the valves 310*a* and 310*b* are opened, is minimized during the change of the refrigerant flow path from the refrigerating compartment 210 to the freezing compartment 220. Accordingly, it is possible to reduce the degree of concentration of the refrigerant from the refrigerating compartment evaporator 205 to the freezing compartment evaporator 207.

Figure 5:
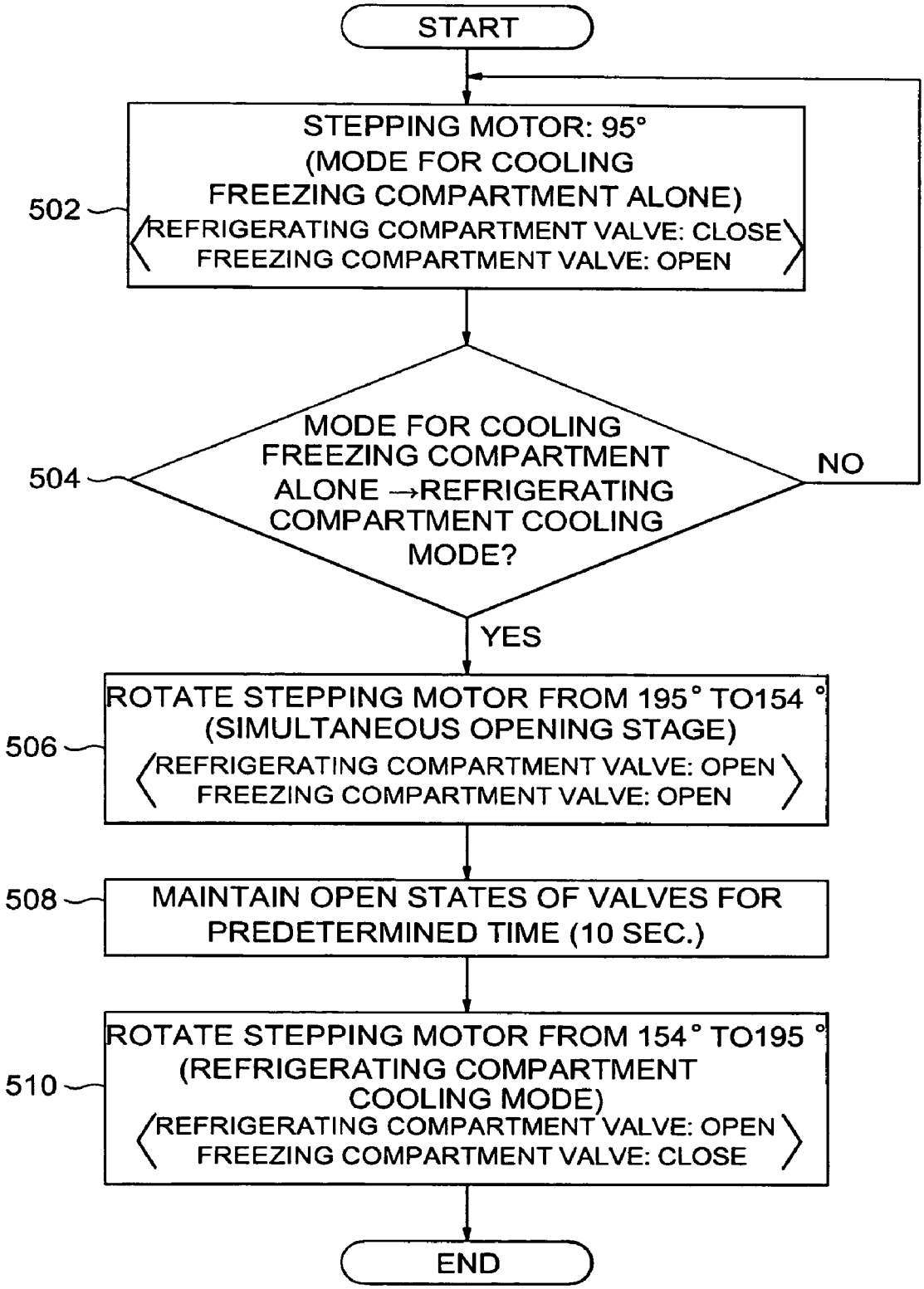
FIG. 5 is a flow chart illustrating a method for controlling the 3-way valve to change the refrigerant flow path from the freezing compartment evaporator to the refrigerating compartment evaporator.

FIG. 5 is a flow chart illustrating a method for controlling the 3-way valve to change the refrigerant flow path from the freezing compartment evaporator to the refrigerating compartment evaporator. As shown in FIG. 5, in a state of the 3-way valve 310 corresponding to a 95°-rotated state of the stepping motor, the refrigerating compartment valve 310*a* is closed, whereas the freezing compartment valve 310*b* is opened. In this state, accordingly, the mode for cooling the freezing compartment 220 alone is executed (Operation 502). After completion of the cooling of the freezing compartment 220 to the target freezing compartment temperature, it is determined whether or not the refrigerating compartment 210 is to be cooled. Based on this determination, it is then determined whether or not the refrigerant flow path is to be changed from the freezing compartment 220 to the refrigerating compartment 210 for execution of the refrigerating compartment cooling mode (Operation 504). When it is necessary to change the refrigerant flow path from the freezing compartment 220 to the refrigerating compartment 210, the rotation angle of the stepping motor is changed from 95° to 154° (Operation 506). This procedure is an intermediate procedure involved in a procedure in which the stepping motor is rotated to 195°. In accordance with the intermediate procedure, a simultaneous opening stage, in which both the refrigerating compartment valve 310*a* and the freezing compartment valve 310*b* are opened, is established. Where the refrigerant flow path is to be changed from the freezing compartment 220 to the refrigerating compartment 210, the simultaneous opening stage established in the intermediate procedure is continued for a predetermined intentional time (for example, 10 seconds) in accordance with the illustrated embodiment of the present invention. That is, both the refrigerating compartment valve 310*a* and the freezing compartment valve 310*b* are opened for the predetermined intentional time (Operation 508). As both the valves 310*a* and 310*b* are opened for the predetermined time during the change of the refrigerant flow path from the freezing compartment 220 to the refrigerating compartment 210, as described above, the refrigerant, which has already been supplied into the freezing compartment evaporator 207, is sufficiently changed from a liquid phase to a gas phase, in order to prevent a liquid refrigerant from entering the compressor 201. Preferably, the predetermined intentional time is set to be longer than the simultaneous opening stage (for example, 3 seconds) inevitably present due to the mechanical characteristics of the stepping motor and 3-way valve 310 when the change of the refrigerant flow path from the refrigerating compartment evaporator 210 to the freezing compartment 220 is carried out (that is, when the stepping motor is rotated from 195° to 95°), in order to more or less delay the point of time when the supply of the refrigerant to the freezing compartment evaporator 207 is cut off. For example, the predetermined intentional time may be 10 seconds. After the predetermined time (10 seconds) elapses, the stepping motor is rotated to 195°, thereby closing the freezing compartment valve 310*b* while maintaining only the refrigerating compartment valve 310*a* in the opened state thereof. That is, the refrigerating compartment cooling mode is executed, in which the refrigerating compartment 210 and freezing compartment 220 are sequentially cooled (Operation 510).

Although the valve employing the stepping motor is used as a path change device in the illustrated embodiment of the present invention, a valve employing a solenoid may be used.

In accordance with the refrigerator control method of the present invention, it is possible to effectively control a path change valve adapted to change a flow path of a refrigerant between evaporators having different pressures such that the quantity of the refrigerant supplied into the low-pressure-side evaporator is gradually reduced, and the quantity of the refrigerant supplied into the high-pressure-side evaporator is gradually increased, when the flow path of the refrigerant is changed from the low-pressure-side evaporator to the high-pressure-side evaporator. Accordingly, it is possible to prevent introduction of a liquid refrigerant into a compressor caused by insufficient phase change of the refrigerant (from a liquid phase to a gas phase) occurring in the low-pressure-side evaporator when the supply of the refrigerant to the low-pressure-side evaporator is suddenly cut off.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a plurality of evaporators comprising at least one low-pressure-side evaporator and at least one high-pressure-side evaporator;

a path change device to change a flow path of a refrigerant between the low-pressure-side evaporator and the high-pressure-side evaporator, the path change device having a simultaneous opening stage to simultaneously establish refrigerant flow paths respectively communicating with the low-pressure-side evaporator and the high-pressure-side evaporator during the path change; and a controller to control the path change device such that the simultaneous opening stage established when the flow path of the refrigerant is changed from the low-pressure-side evaporator to the high-pressure-side evaporator is longer than the simultaneous opening stage established when the flow path of the refrigerant is changed from the high-pressure-side evaporator to the low-pressure-side evaporator.

2. The refrigerator according to claim 1, wherein:

the low-pressure-side evaporator is a freezing compartment evaporator to cool a freezing compartment of the refrigerator; and the high-pressure-side evaporator is a refrigerating compartment evaporator to cool a refrigerating compartment of the refrigerator.

3. The refrigerator according to claim 1, wherein;

the simultaneous opening stage established when the flow path of the refrigerant is changed from the high-pressure-side evaporator to the low-pressure-side evaporator is an opening stage inevitably established due to a mechanical characteristic limitation of the path change device; and the simultaneous opening stage established when the flow path of the refrigerant is changed from the low-pressure-side evaporator to the high-pressure-side evaporator is an intentional opening stage longer than the inevitable simultaneous opening stage.

4. The refrigerator according to claim 3, wherein:

the path change device is a 3-way valve to change the refrigerant flow path in accordance with a rotation of a stepping motor; and the mechanical characteristic limitation of the path change device is a rotating speed limitation of the stepping motor.

5. A method for controlling a refrigerator including a plurality of evaporators comprising at least one low-pressure-side evaporator and at least one high-pressure-side evaporator, and a path change device to change a flow path of a refrigerant between the low-pressure-side evaporator and the high-pressure-side evaporator, the path change device having a simultaneous opening stage to simultaneously establish refrigerant flow paths respectively communicating with the low-pressure-side evaporator and the high-pressure-side evaporator during the path change, the method comprising:

controlling the path change device such that the simultaneous opening stage established when the flow path of the refrigerant is changed from the low-pressure-side evaporator to the high-pressure-side evaporator is longer than the simultaneous opening stage established when the flow path of the refrigerant is changed from the high-pressure-side evaporator to the low-pressure-side evaporator.

6. The method according to claim 5, wherein:

the low-pressure-side evaporator is a freezing compartment evaporator to cool a freezing compartment of the refrigerator; and the high-pressure-side evaporator is a refrigerating compartment evaporator to cool a refrigerating compartment of the refrigerator.

7. The method according to claim 5, wherein:

the simultaneous opening stage established when the flow path of the refrigerant is changed from the high-pressure-side evaporator to the low-pressure-side evaporator is an opening stage inevitably established due to a mechanical characteristic limitation of the path change device; and the simultaneous opening stage established when the flow path of the refrigerant is changed from the low-pressure-side evaporator to the high-pressure-side evaporator is an intentional opening stage longer than the inevitable simultaneous opening stage.

8. The method according to claim 7, wherein:

the path change device is a 3-way valve to change the refrigerant flow path in accordance with a rotation of a stepping motor; and the mechanical characteristic limitation of the path change device is a rotating speed limitation of the stepping motor.

* * * * *

UNITED STATES PATENT AND TRADEMARK OFFICE

CERTIFICATE OF CORRECTION

PATENT NO. : 7,441,413 B2
APPLICATION NO. : 11/106488
DATED : October 28, 2008
INVENTOR(S) : Hak-Gyun Bae et al.

It is certified that error appears in the above-identified patent and that said Letters Patent is hereby corrected as shown below:

Column 8, Line 23, change “wherein;” to --wherein:--.

Signed and Sealed this

Twenty-seventh Day of January, 2009

JOHN DOLL
*Acting Director of the United States Patent and Trademark Office*